US011778393B2

(12) United States Patent
Nielsen et al.

(10) Patent No.: US 11,778,393 B2
(45) Date of Patent: Oct. 3, 2023

(54) METHOD OF OPTIMIZING PARAMETERS IN A HEARING AID SYSTEM AND A HEARING AID SYSTEM

(71) Applicant: Widex A/S, Lynge (DK)

(72) Inventors: Jens Brehm Bagger Nielsen, Ballerup (DK); Asger Ougaard, Frederikssund (DK); Lasse Lohilahti Molgaard, Bagsvaerd (DK); Caspar Aleksander Bang Jespersen, Copenhagen V (DK)

(73) Assignee: Widex A/S, Lynge (DK)

( * ) Notice: Subject to any disclaimer, the term of this patent is extended or adjusted under 35 U.S.C. 154(b) by 152 days.

(21) Appl. No.: 17/421,091

(22) PCT Filed: Jan. 7, 2020

(86) PCT No.: PCT/EP2020/050176
§ 371 (c)(1),
(2) Date: Jul. 7, 2021

(87) PCT Pub. No.: WO2020/144160
PCT Pub. Date: Jul. 16, 2020

(65) Prior Publication Data

US 2022/0109940 A1 Apr. 7, 2022

(30) Foreign Application Priority Data

Jan. 8, 2019 (DK) ..... PA201900021

(51) Int. Cl.
*H04R 25/00* (2006.01)

(52) U.S. Cl.
CPC ..... *H04R 25/507* (2013.01); *H04R 25/558* (2013.01); *H04R 2225/39* (2013.01); *H04R 2225/41* (2013.01)

(58) Field of Classification Search
CPC ..... H04R 25/507; H04R 25/558; H04R 2225/39; H04R 2225/41; H04R 25/70; H04R 25/75; H04R 25/505
See application file for complete search history.

(56) References Cited

U.S. PATENT DOCUMENTS

| | | | |
|---|---|---|---|
| 2011/0060702 | A1 | 3/2011 | Lineaweaver |
| 2012/0288119 | A1 | 11/2012 | Apfel |
| 2015/0281853 | A1 | 10/2015 | Eisner et al. |
| 2018/0256895 | A1 | 9/2018 | von Brasch et al. |

FOREIGN PATENT DOCUMENTS

| | | | | |
|---|---|---|---|---|
| EP | 1 713 302 | A1 | 10/2006 | |
| EP | 1 946 609 | B1 | 5/2010 | |
| EP | 3 167 625 | A1 | 5/2017 | |
| EP | 3167625 | A1 * | 5/2017 | ..... G06F 3/162 |
| EP | 3 267 695 | A1 | 1/2018 | |
| EP | 3 331 254 | A1 | 6/2018 | |

(Continued)

OTHER PUBLICATIONS

EP-3331254 A1 (Year: 2018).*

(Continued)

*Primary Examiner* — Brian Ensey
(74) *Attorney, Agent, or Firm* — Sughrue Mion, PLLC

(57) ABSTRACT

A hearing aid system (100) adapted to provide improved user personalization and a method of operating such a hearing aid system.

8 Claims, 2 Drawing Sheets

(56) References Cited

FOREIGN PATENT DOCUMENTS

| | | | | |
|---|---|---|---|---|
| EP | 3331254 | A1 * | 6/2018 | ..... H04R 25/30 |
| WO | 2006/136174 | A2 | 12/2006 | |

OTHER PUBLICATIONS

EP-3167625 A1 (Year: 2017).*
Search Opinion for corresponding PA 2019 00021, dated Aug. 27, 2019.
Search Report for corresponding PA 2019 00021, dated Aug. 27, 2019.
Written Opinion for PCT/EP2020/050176, dated Apr. 2, 2020.
International Search Report for PCT/EP2020/050176, dated Apr. 2, 2020.

* cited by examiner

METHOD OF OPTIMIZING PARAMETERS IN A HEARING AID SYSTEM AND A HEARING AID SYSTEM

CROSS REFERENCE TO RELATED APPLICATIONS

This application is a National Stage of International Application No. PCT/EP2020/050176 filed Jan. 7, 2020, claiming priority based on Danish Patent Application No. PA201900021 filed Jan. 8, 2019.

The present invention relates to a method of optimizing parameters in a hearing aid system. The invention also relates to a hearing aid system adapted for optimizing parameters.

BACKGROUND OF THE INVENTION

Within the context of the present disclosure a hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor adapted to provide amplification in those parts of the audible frequency range where the user suffers a hearing deficit, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with other devices of the hearing aid system. Thus within the present context the term "hearing aid system device" may denote a hearing aid or an external device.

Generally a hearing aid system according to the invention is understood as meaning any system which provides an output signal that can be perceived as an acoustic signal by a user or contributes to providing such an output signal and which has means which are used to compensate for an individual hearing loss of the user or contribute to compensating for the hearing loss of the user. These systems may comprise hearing aids which can be worn on the body or on the head, in particular on or in the ear, and can be fully or partially implanted. However, some devices whose main aim is not to compensate for a hearing loss may nevertheless be considered a hearing aid system, for example consumer electronic devices (televisions, hi-fi systems, mobile phones, MP3 players etc.) provided they have measures for compensating for an individual hearing loss.

It is well known within the art of hearing aid systems that most users will benefit from a hearing aid programming (this process may also be denoted fitting) that takes the user's personal preferences into account. This type of fine tuning or optimization of the hearing aid system settings may be denoted personalization or using a more generic term it may be denoted a machine learning procedure. However, it is well known that the process of personalization is a very challenging one.

One problem with personalization is that it may be very difficult for a user to explain in words what types of signal processing and the resulting sounds that are preferred.

Personalization may generally be advantageous with respect to basically all the various types of signal processing that are carried out in a hearing aid system. Thus personalization may be relevant for e.g. noise reduction as well as for classification of the sound environment.

EP-B1-1946609 discloses a method for optimization of hearing aid parameters. The method is based on Bayesian incremental preference elicitation whereby at least one signal processing parameter is adjusted in response to a user adjustment. According to a specific embodiment the user adjustment is simply an indication of user dissent.

EP-B1-1946609 is complicated in so far that it applies a parameterized approach in order to model the user's unknown internal response function (i.e. the user's preference), because it is very difficult to find a suitable parameterized model that suits the great variety of hearing aid system users unknown internal response functions.

Furthermore EP-B1-1946609 is complicated because the processing and memory requirements are very high, especially for hearing aid systems that generally have limited processing and memory resources.

It is therefore a feature of the present invention to provide an improved method of optimizing a hearing aid system setting with respect to at least ease of use, time spent by the user and the general user satisfaction.

It is another feature of the present invention to provide a hearing aid system with such improved means for optimizing a hearing aid system setting.

Additionally, the inventor has found that internally generated sounds that are used for providing comfort, be it for masking undesired sounds or for causing a relaxing experience, may benefit significantly from personalization.

In the context of the present disclosure, a relaxing sound should be understood as a sound having a quality whereby it is easy to relax and be relieved of e.g. stress and anxiety when subjected to it. Traditional music is one example of relaxing sound while noise is most often used to refer to a sound that is not relaxing.

In the context of the present disclosure, a relaxing sound may especially be understood as a sound adapted for relieving tinnitus.

However, in the present context, internally generated sounds may also be used for other purposes than providing comfort.

SUMMARY OF THE INVENTION

The invention, in a first aspect, provides a hearing aid system according to claim 1.

This provides an improved hearing aid system with respect to user personalization.

The invention, in a second aspect, provides a method of operating a hearing aid system according to claim 9.

This provides an improved method of operating a hearing aid system in order to adapt the hearing aid system settings to a user's preference.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

In the present context the term internally generated sound represents sound that is generated synthetically in a hearing aid. The sound may be generated for a great variety of purposes including helping a user to concentrate, to feel more relaxed and comfortable, to reduce stress and to feel less anxious.

According to an aspect of the invention it has been found that it provides a significant improvement for the user if the hearing aid system settings can be adapted to the user's current preferences (i.e. personalized). This is even more so because the user's preferences may vary significantly up to several times during a day, as a function of e.g. the time of day (morning, afternoon or evening) or the user's mood or the type of activity the user is engaged in.

As a consequence of these varying preferences of many users it provides a significant improvement for the user if the personalization can be carried out without having to spend too much time optimizing the settings.

As an additional consequence of the varying preferences of many users it has been found that it provides a significant improvement for the user if the personalization generally can be carried out using only the hearing aid system with its limited processing resources, because this allows the personalization to be carried out anywhere and at any time.

Furthermore, it has been found that it is of significant importance that the personalization can be carried out without requiring the user to interact with the hearing aid system in a complex manner.

According to one specific embodiment, analytical expressions allowing personalization of hearing aid system settings to be carried out with beforehand unseen processing efficiency can be derived if a hearing aid system user is prompted to compare two hearing aid system settings and rate how much one of the settings is preferred above the other.

As described above the present invention may be especially advantageous for personalization of internally generated sounds.

One example of internally generated sounds that are suitable for implementation in a hearing aid system can be found e.g. in WO-A1-02/41296

Further it has been found that artificially generated relaxing sounds such as those disclosed in WO-A1-02/41296 are advantageously personalized by optimizing the ranges wherein parameters used to control the generation of sound are allowed to vary pseudo-randomly. However, as one alternative to that personalization approach it has been found that optimization of the harmonic characteristics of the generated relaxing sounds may provide a significant improvement for the user.

Figure 2:
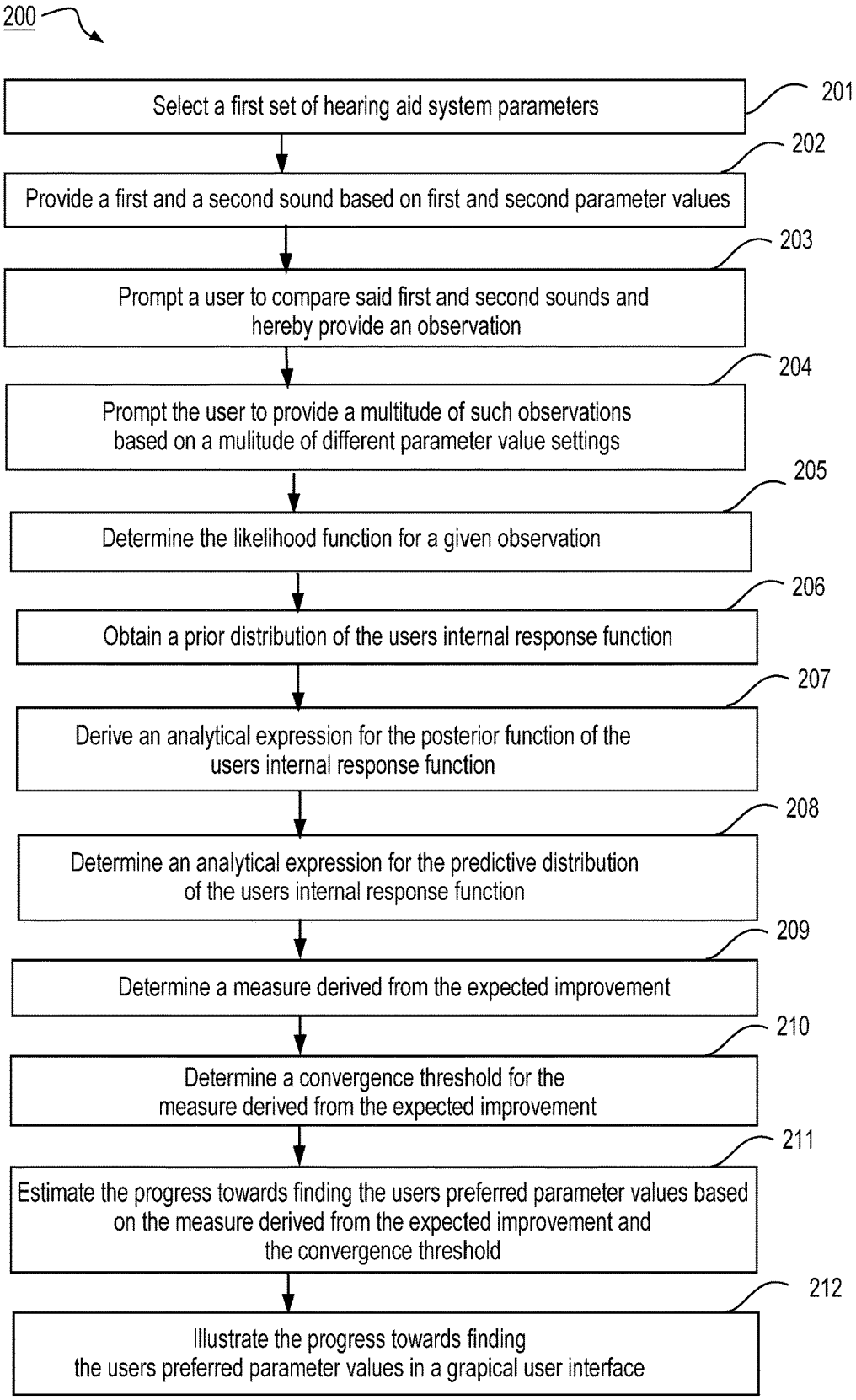
FIG. 2 illustrates highly schematically a method of operating a hearing aid system according to an embodiment of the invention.

Reference is first made to FIG. 2 which illustrates highly schematically a method 200 of operating a hearing aid system according to a first embodiment of the invention.

In a first step 201 a set of parameters are selected from the group of parameters that controls the hearing aid system setting.

The parameters are selected such that they, when varied over their allowed range, are able to provide a multitude of settings that are at least perceived as having a significant variation with respect to all the various types of signal processing that are carried out in a hearing aid system, including e.g. noise reduction and internally generated sounds.

According to one variation of the present embodiment and having reference to WO-A1-02/41296 the set of parameters comprises the specific harmonics added to the signals generated by a multitude of sound generators according to the embodiments of WO-A1-02/41296. Hereby, the sound generators are personalized to provide sound with the harmonic characteristics preferred by the user.

In a second step 202 a first and second set of parameter values are selected (this may also be denoted the first and second parameter value settings, or just the first and second settings), whereby a first sound is generated and provided to the user based on the first set of parameter values and a second sound is generated and provided to the user based on the second set of parameter values. According to the present embodiment the first and second sets of parameter values are selected randomly.

In variations the first and second set of parameter values need not be selected randomly. Instead the first set of parameter values may be e.g. the set that was active when powering off the hearing aid system.

Consider now a d-dimensional vector x containing the values of the d selected parameters that controls the generation of sound by the hearing aid system:

$$x=[x_1, \ldots, x_d]^T$$

In the following a d-dimensional vector x with specific values of the d parameters may also be denoted a setting or a parameter value setting.

In a third step 203 the user is prompted to compare the first and second sound and provide a first user response (that in the following may also be denoted an observation) that allows a determination of which of the two sounds the user prefers.

According to the present embodiment the observations comprise a graduated response whereby the user rates how much the first sound (and hereby the first parameter value setting) is preferred above the second sound (and hereby the second parameter value setting) by selecting a number from within a bounded range (that may also be denoted an interval) between zero and one, such that a user response of one implies that e.g. the first parameter value setting is indefinitely better than the second parameter value setting and zero implying that the second set is indefinitely better than the first set and that a value of one half implies that the two options are rated to be equally good.

In variations of the present embodiment the bounded range may cover basically any range such as e.g. the range from −1 to +1 or the range from −10 to +10. However, it is emphasized that within the current embodiment a test where a user selects either one or another setting can't be considered to provide a user's rating of the settings relative to each other. Thus, within the present context when the user response takes the form of a number from a bounded range, then this range (or interval) has more than two elements.

In a fourth step 204 the user provides a multitude of additional user responses (which in the following may also be denoted observations) based on a multitude of parameter value settings, wherein a set $\chi$ of the n tested parameter value settings may be given as:

$$\chi=\{x_i\in \mathbb{R}^d : i=1, \ldots, n\}$$

and wherein a vector of m bounded observations are related to pairs of sounds based on the settings $x_{u_k}$, $x_{v_k}\in\chi$, implying that $u_k$, $v_k\in\{1, \ldots, n\}$, such that:

$$y=[y_1, \ldots, y_m]^T$$

Wherein the bounded observations are of the form $$y_k\in\, ]a;b[$$

The set $\chi^*$ of all n* possible parameter value settings is expressed as:

$$\chi^*=\{x_r^* r\in \mathbb{R}^d : r=1, \ldots, n^*\}$$

The user's unknown internal response function is denoted f and is assumed to code the user's perception of a particular sound given the setting x of the parameter values.

$$f: \mathbb{R}^d \rightarrow \mathbb{R}, x \mapsto f(x)$$

In the following a (stochastic) vector f is defined as containing the function values $f(x_i)$ for each of the n settings in $\chi$ of the user's internal response function f:

$$f=[f(x_1), \ldots, f(x_n)]^T$$

According to the embodiment the vector of bounded observations y are warped to a vector of unbounded observations z. This is done using a warping function defined by mapping a bounded, or partly bounded observation, y, to an unbounded observation, z=g(y), with:

$$g: ]a;b[ \rightarrow \mathbb{R} \mapsto g(y)$$

Suitable functions for carrying out the mapping may be selected from a group of monotonically increasing functions comprising: inverse cumulative distribution function of the Gaussian distribution, inverse sigmoid function and inverse hyperbolic tangent function.

By mapping or warping the observations (in the following these terms may be used interchangeably) in this way the performance of the personalization method may be improved both with respect to the speed of convergence (i.e. the number of user responses required to find the parameter value settings that the user prefers) and with respect to robustness (i.e. the chance that the personalization method is capable of providing a prediction that reflects the users internal response function). However, it is not a prerequisite for the methods of the present invention that warping is applied.

In the following it is assumed that the warped observations z are given by:

$$z=f(x_u)-f(x_v)+\epsilon$$

wherein $\epsilon$ is Gaussian noise ($\epsilon\sim N(0,\sigma^2)$) that is independent and identically distributed and represents the uncertainty of the user when carrying out the graduated responses.

Based on this assumption the likelihood function for observing z can be determined directly as:

$$p(z_k|f(x_u),f(x_v),\sigma^2)=\mathcal{N}(z_k|f(x_u)-f(x_v),\sigma^2)$$

wherein $z_k$ represents a specific warped user response, wherein $\sigma^2$ represents the variance of the user response and wherein $\mathcal{N}(z_k|f(x_u)-f(x_v),\sigma^2)$ is the single variate Gaussian distribution over the variable $z_k$ with mean value $f(x_u)-f(x_v)$ and variance $\sigma^2$. In the following the variance $\sigma^2$ may also be denoted the likelihood hyper parameter $\theta_{lik}$.

In a fifth step the likelihood is determined using the following expression as:

$$p(z\mid f, \theta_{lik}) = \prod_{k=1}^{m} \mathcal{N}\left(z_k \mid f(x_{u_k}) - f(x_{v_k}), \sigma^2\right) = \mathcal{N}\left(z \mid Mf, \sigma^2 I_{m\times m}\right),$$

wherein $I_{m\times m}$ is an m×m identity matrix, $z=[z_1, \ldots, z_m]^T=[g(y_1), \ldots, g(y_m)]^T$, the matrix M is a m×n matrix, comprising only zeros except for the elements $[M]_{k,u_k}=1$ and $[M]_{k,v_k}=-1$.

Thus $\mathcal{N}(z|Mf,\sigma^2 I_{m\times m})$ represents a multivariate Gaussian distribution over the set of user responses z with mean vector Mf and covariance matrix $\sigma^2 I_{m\times m}$.

In a sixth step a prior distribution $p(f|\chi,\theta_{cov})$ over the function values of the user's unknown internal response function is obtained from a zero-mean Gaussian process. This is obtained based on the fact that a zero-mean Gaussian process defines a joint distribution over a finite set of function values, f, as a multivariate Gaussian distribution $$p(f|\chi,\theta_{cov})=N(f|0,K)$$

where the covariance between any two function values is given by a positive semi-definite covariance function, $k(x_i, x_j, \theta_{cov})$, such that the covariance matrix K is determined by:

$$K = \begin{bmatrix} k(x_1, x_1, \theta_{cov}) & \ldots & k(x_1, x_n, \theta_{cov}) \\ \vdots & \ddots & \vdots \\ k(x_n, x_1, \theta_{cov}) & \ldots & k(x_n, x_n, \theta_{cov}) \end{bmatrix}$$

and wherein k is the squared exponential covariance function (that may also be denoted the Gaussian kernel) that is defined as:

$$k(x_i,x_j)=\sigma_f \mathrm{Exp}(-\tfrac{1}{2}(x_i-x_j)^T L^{-1}(x_i-x_j))$$

wherein $\sigma_f$ and the positive semi-definite matrix L are the covariance hyper parameters, that primarily determines the smoothness of the user's internal response function. The covariance hyper parameters $\sigma_f$ and L may together be denoted $\theta_{cov}$.

Generally the prior obtained from a Gaussian Process (that in the following may be abbreviated GP) captures the assumption about the smoothness of the users internal response function f as a function of the parameter value settings x and interplay between the different hearing aid parameters.

It is a fundamental property of a Gaussian process that you can always get the joint distribution of any finite set of function values from a function f(x) modeled by a Gaussian Process. Hence, we can concatenate two vectors containing function values and get the corresponding joint distribution, e.g. as.

$$p\left(\begin{bmatrix} f \\ f^* \end{bmatrix} \middle| X, X^*, \theta_{cov}\right) = \mathcal{N}\left(\begin{bmatrix} f \\ f^* \end{bmatrix} \middle| \begin{bmatrix} 0 \\ 0 \end{bmatrix}, \begin{bmatrix} K & K_* \\ K_*^T & K_{**} \end{bmatrix}\right),$$

where:

$$[K_*]_{i,s}=k(x_i,x_s^*,\theta_{cov})$$

$$[K_{**}]_{r,s}=k(x_r^*,x_s^*,\theta_{cov})$$

Wherefrom it is trivial to obtain the conditional distribution of one vector of function values given the other vector. E.g.:

$$p(f^*|f,\chi,\chi^*,\theta_{cov})=\mathcal{N}(f^*|K_*^TK^{-1}f,K_{**}-K_*^TK^{-1}K_*)$$

However, in variations of the present embodiment other positive semi-definite covariance functions may be applied instead of the Gaussian kernel. Examples of such covariance functions are the y-exponential covariance function, the Matern class of covariance functions, the rational quadratic covariance function, periodic covariance functions and linear covariance functions.

According to a variation the hyper parameters $\theta=\{\theta_{cov},\theta_{lik}\}$ are selected based on a maximization of the expression for the marginal likelihood, whereby the likelihood of the observed data is also maximized. The marginal likelihood is determined based on the likelihood $p(z|f,\theta_{lik})$ and the prior $p(f|\chi,\theta_{cov})$:

$$p(z|\chi,\theta)=\int p(z|f,\theta_{lik})\cdot p(f|\chi,\theta_{cov})df\propto p(y|\chi,\theta)$$

The last proportional sign holds if the warping function is fixed, meaning that it does not contain hyper-parameters that need to be optimized.

Typically a ML-II or MAP-II optimization technique is applied. But in variations of the present embodiment other optimization techniques may be applied as well.

When applying the ML-II method then the maximization of the marginal likelihood with respect to the hyper parameters is achieved by minimizing the negative log marginal likelihood with respect to the hyper parameters:

$$\theta_{ML-II}=\underset{\theta}{\operatorname{argmax}}\,p(z\,|\,\mathcal{X},\theta)=\underset{\theta}{\operatorname{argmin}}(-\log p(z\,|\,\mathcal{X},\theta))$$

According to a variation of the present embodiment a method known as MAP-II may be applied, wherein the marginal likelihood is regularized with a suitable hyper prior distribution, $p(\theta)$, such as e.g. the half-student's-t distribution, the Gamma distribution, the Laplace distribution, the Gaussian distribution or a uniform prior for noise parameters.

Subsequently the regularized marginal likelihood is maximized with respect to $p(\theta|z,\chi)\propto p(z|\chi,\theta)p(\theta)$ by finding the minimum of the negative logarithmic. Thus the MAP-II optimization is given by:

$$\begin{aligned}\theta_{MAP-II}&=\underset{\theta}{\operatorname{argmax}}\,p(z\,|\,\mathcal{X},\theta)p(\theta)\\&=\underset{\theta}{\operatorname{argmin}}(-\log p(z\,|\,\mathcal{X},\theta)-\log p(\theta))\\&=\underset{\theta}{\operatorname{argmin}}\begin{pmatrix}\frac{1}{2}\log\det(MKM^T+\sigma^2I_{m\times m})+\\\frac{1}{2}z^T(MKM^T+\sigma^2I_{m\times m})^{-1}z-\log p(\theta)\end{pmatrix},\end{aligned}$$

This method is especially advantageous when fewer than say 50 observations are available, which is typically the case when customizing hearing aid systems.

An analytical expression for the marginal likelihood is derived by marginalizing the joint distribution between function values and observations over the function values. This joint distribution is the product of the likelihood and the prior hereby providing:

$$p(z|\chi,\theta)=\mathcal{N}(z|0,MKM^T+\sigma^2I_{m\times m})$$

When using the marginal likelihood for either MAP-II or ML-II optimization of hyper parameters it is typically more numerically robust to minimize the negative logarithmic of the marginal likelihood:

$$-\log p(z\,|\,\mathcal{X},\theta)=\frac{m}{2}\log 2\pi+\frac{1}{2}\log\det(MKM^T+\sigma^2I_{m\times m})+\frac{1}{2}z^T(MKM^T+\sigma^2I_{m\times m})^{-1}z$$

or if considering the original non-warped observations $\mathcal{Y}$:

$$-\log p(y\,|\,\mathcal{X},\theta)=\frac{m}{2}\log 2\pi+\frac{1}{2}\log\det(MKM^T+\sigma^2I_{m\times m})+\frac{1}{2}z^T(MKM^T+\sigma^2I_{m\times m})^{-1}z-\sum_{k=1}^{m}\log\frac{\partial g(y)}{\partial y}\bigg|_{y_k}$$

Note, that the last term appended for the negative log marginal likelihood of y is the Jacobian, and that the Jacobian does not depend on the hyper parameters, if the warping is fixed. Therefore, the Jacobian does not influence the gradient ascend/descend optimization of hyper parameters, and can therefore be neglected when performing the ML-II or MAP-II optimization of hyper parameters.

According to a variation of the present embodiment the warping function is the inverse cumulative density function of the Gaussian distribution, $\Phi^{-1}(y)$, in which case the Jacobian term is easily found as:

$$g(y)=\Phi^{-1}(y)\Rightarrow\frac{\partial g(y)}{\partial y}=\frac{1}{\mathcal{N}(\Phi^{-1}(y)\,|\,0,1)}$$

Thus by deriving an analytical expression for the negative logarithmic of the marginal likelihood and hereby also the gradient of the negative logarithmic of the marginal likelihood with respect to the hyper parameters the hyper parameters may be determined in a very processing efficient manner.

However, in variations of the present embodiment the hyper parameters of the covariance and likelihood may simply be set using experience from similar situations to provide a qualified guess. In a specific variation the hyper parameters are set based on experience from other hearing aid system users.

In other variations the warping function may contain hyper parameters.

In a seventh step an analytical posterior distribution over the unknown function values of the user's internal response function $p(f|z,\chi,\theta)$ is derived based on Bayes rule:

$$p(f\,|\,z,\mathcal{X},\theta)=\frac{p(z\,|\,f,\theta_{lik})\cdot p(f\,|\,\mathcal{X},\theta_{cov})}{p(z\,|\,\mathcal{X},\theta)}$$

By applying the novel pairwise Gaussian likelihood given previously, the prior derived using a Gaussian process and the marginal likelihood as the integral over the user's internal response function of the product of the likelihood and the prior, then an analytical expression for the posterior can be found as:

$$p(f \mid z, X, \theta) = \mathcal{N}(f \mid \mu, \textstyle\sum)$$

$$\mu = K(M^T MK + \sigma^2 I_{n\times n})^{-1} M^T z$$

$$\Sigma = \left(K^{-1} + \frac{1}{\sigma^2} M^T M\right)^{-1}$$

In an eighth step an analytical expression for the predictive distribution over the unknown function values of the user's internal response function is found. In full Bayesian modeling, predictions come in terms of a predictive distribution of new function values, $f^*=[f(x_1^*), \ldots, f(x_{n^*}^*)]^T$ given the observations, y or in case of warped observations z. Hence, the predictive distribution is a conditional distribution and the conditional is on the observations only. It is derived from $$p(f\&|z,\chi,\chi^*,\theta)=\int_p(f^*|f,\chi,\chi^*,\theta_{cov})p(f|z,\chi,\theta)df$$

Note, that $p(f^*|f, \chi, \chi^*, \theta_{cov})$ is Gaussian due to the Gaussian Process as already discussed previously with reference to the sixth step. Since the posterior distribution, according to the present embodiment is a Gaussian distribution on the form $p(f|z, \chi, \theta)=\mathcal{N}(f|\mu,\Sigma)$, then the solution to the integral has an analytical solution and the predictive distribution is given, by inserting the mean and covariance from the posterior distribution, hereby obtaining:

$$\begin{aligned} p(f^* \mid z, X, X^*, \theta) &= \int p(f^* \mid f, X, X^*, \theta_{cov}) p(f \mid z, X, \theta) df \\ &= \int \mathcal{N}(f^* \mid K_*^T K^{-1} f, K_{**} - K_*^T K^{-1} K_*) \cdot \\ &\quad \mathcal{N}(f \mid \mu, \textstyle\sum) df \\ &= \mathcal{N}(f^* \mid K_*^T K^{-1} \mu, K_{**} - K_*^T (K^{-1} + K^{-1} \textstyle\sum K^{-1}) K_*^T) \\ &= \mathcal{N}(f^* \mid K_*^T (M^T MK + \sigma^2 I_{n\times n})^{-1} M^T z, K_{**} - \\ &\quad K_*^T (M^T MK + \sigma^2 I_{n\times n})^{-1} M^T MK_*) \end{aligned}$$

where:

$$K_* = \begin{bmatrix} k(x_1, x_1^*, \theta_{cov}) & \ldots & k(x_1, x_n^*, \theta_{cov}) \\ \vdots & \ddots & \vdots \\ k(x_n, x_1^*, \theta_{cov}) & \ldots & k(x_n, x_n^*, \theta_{cov}) \end{bmatrix}$$

and:

$$K_{**} = \begin{bmatrix} k(x_1^*, x_1^*, \theta_{cov}) & \ldots & k(x_1^*, x_n^*, \theta_{cov}) \\ \vdots & \ddots & \vdots \\ k(x_{n^*}^*, x_1^*, \theta_{cov}) & \ldots & k(x_{n^*}^*, x_{n^*}^*, \theta_{cov}) \end{bmatrix}$$

Consider now the mean vector of the predictive distribution and denote it $\mu^*$, which from the expressions above is given by $$\mu^*=K_*^T(M^T MK+\sigma^2 I_{n\times n})^{-1} M^T z$$

wherefrom it directly follows that only the term $K_*$ depends on the parameter value settings belonging to $\chi^*$.

The parameter value setting, that the user prefers among all possible settings (i.e. the set $\chi^*$) can be found by considering a case where $\chi^*$ contains only one setting, x*, implying that n*=1, whereby we get:

$$K_*=[k(x^*,x_1,\theta_{cov}), \ldots, k(x^*,x_n,\theta_{cov})]^T=k(x^*)$$

This is a function, which takes a single input x* and returns a vector of covariance function outputs for every tested parameter value setting, $x_i$. Thereby, we can interpret the mean value of the predictive distribution as a function of a single parameter value setting that returns the corresponding mean function value as $$\mu^*(x^*)=k(x^*)^T(M^T MK+\sigma^2 I_{n\times n})^{-1} M^T z=k(x^*)^T \cdot B,$$

where the matrix B does not depend on x*.

This interpretation of the mean value as function taking a single input makes it possible to find the (local) maximum of the mean of the predictive distribution with respect to the input, x*, using the gradient given by:

$$\frac{\partial \mu^*(x^*)}{\partial x^*} = \left[\frac{\partial k_*(x^*)}{\partial x^*}\right]^T (M^T MK + \sigma^2 I_{n\times n})^{-1} M^T z.$$

Thus hereby is provided an estimate of the parameter value setting that the user prefers, among all the possible parameter value settings, wherein the estimate can be provided using only very limited processing and memory resources due to the availability of an analytical expression for the gradient.

However, according to a variation of the present embodiment the parameter value setting that the user prefers, among the tested settings, can be found by considering that in this case the parameter value settings in the set $\chi^*$ are the same as the settings that have been presented to the user (i.e. the settings belonging to $\chi$) and consequently we have:

$$K_* = \begin{bmatrix} k(x_1, x_1, \theta_{cov}) & \ldots & k(x_1, x_n, \theta_{cov}) \\ \vdots & \ddots & \vdots \\ k(x_n, x_1, \theta_{cov}) & \ldots & k(x_n, x_n, \theta_{cov}) \end{bmatrix} = K$$

and consequently:

$$\mu^*=K_*^T(M^T MK+\sigma^2 I_{n\times n})^{-1} M^T z=K(K^T MK+\sigma^2 I_{n\times n})^{-1} M^T z$$

Hereby an estimate of the parameter value setting that the user prefers can be found with a method that requires even fewer processing and memory resources than the present embodiment, because the set $\chi$ is typically of limited size and therefore can be found without a gradient approach.

However, according to the present embodiment, the settings that the user is prompted to compare are not selected randomly. Instead the next new setting, to be compared with the current best parameter value setting $\hat{x}$, is found as the parameter value setting $\hat{x}^*$ that maximizes a bivariate Expected Improvement, given by:

$$\hat{x}^* = \underset{x^*}{\operatorname{argmax}}\left(\mu_I \Phi\left(\frac{\mu_I}{\sigma_I}\right) + \sigma_I N\left(\frac{\mu_I}{\sigma_I} \middle| 0, 1\right)\right),$$

wherein:

$$\mu_I = \mu^* - \mu_{max} = (k_*(x^*) - k_*(\hat{x})) \cdot \left(M^T MK + \sigma^2 I_{n\times n}\right)^{-1} M^T z,$$

and $$\begin{aligned}\sigma_I^2 &= \sigma_*^2 + \sigma_{max}^2 - 2Cov_{max,*} \\ &= k(x^*, x^*) + k(\hat{x}, \hat{x}) - k(x^*, \hat{x}) - \\ &\quad k_*(x^*)^T\left(M^T MK + \sigma^2 I_{n\times n}\right)^{-1} M^T Mk_*(x^*) - \\ &\quad k_*(\hat{x})^T\left(M^T MK + \sigma^2 I_{n\times n}\right)^{-1} M^T Mk_*(\hat{x}) - \\ &\quad k_*(x^*)^T\left(M^T MK + \sigma^2 I_{n\times n}\right)^{-1} M^T Mk_*(\hat{x}),\end{aligned}$$

and:

$$k_*(x)=[k(x,x_i), \ldots ,k(x,x_n)]$$

and wherein $$\Phi\left(\frac{\mu_I}{\sigma_I}\right)$$

is the standard cumulative distribution function of the Gaussian distribution.

It is a further specific advantage of the analytical expression for the bivariate Expected Improvement that it allows an analytical expression for the gradient of the bivariate Expected improvement to be derived:

$$\frac{\partial}{\partial x^*}\left\{\mu_I\Phi\left(\frac{\mu_I}{\sigma_I}\right) + \sigma_I \mathcal{N}\left(\frac{\mu_I}{\sigma_I}\middle|0, 1\right)\right\} = \frac{\partial \sigma_I}{\partial x^*}\mathcal{N}\left(\frac{\mu_I}{\sigma_I}\middle|0, 1\right) + \frac{\partial \mu_I}{\partial x^*}\Phi\left(\frac{\mu_I}{\sigma_I}\right),$$

$$\text{Where } \frac{\partial \mu_I}{\partial x^*} = \left[\frac{\partial k_*(x^*)}{\partial x^*}\right]^T \left(M^T MK + \sigma^2 I_{n\times n}\right)^{-1} M^T z \text{ and}$$

$$\frac{\partial \sigma_I}{\partial x^*} = \frac{1}{\sigma_I}\left(\frac{1}{2}\frac{\partial k(x^*, x^*)}{\partial x^*} - \left[\frac{\partial k_*(x^*)}{\partial x^*}\right]^T \left(M^T MK + \sigma^2 I_{n\times n}\right)^{-1} M^T Mk_*(x^*) - \frac{\partial k(x^*, \hat{x})}{\partial x^*} + \left[\frac{\partial k_*(x^*)}{\partial x^*}\right]^T \left(M^T MK + \sigma^2 I_{n\times n}\right)^{-1} M^T Mk_*(\hat{x})\right)$$

When deriving the analytical expression for the bivariate Expected Improvement the inventor has considered that when using a Gaussian Process to model the function value, $f(x^*)$, of a new (i.e. not yet tested) parameter value setting $x^*$, then the function value of the new parameter value setting, $x^*$, co-varies with the function value, $f(\hat{x})$, at the current maximum, $\hat{x}$.

The original univariate Expected Improvement formulation does not consider this, instead the formulation requires the, $f(\hat{x})$, to be deterministically defined. Consequently, when using the univariate Expected Improvement with Gaussian Processes the mean function value at the maximum point $\hat{\mu}$ is used as the deterministic prediction of the corresponding function value, $f(\hat{x})$, thus neglecting both the variance, $\hat{\sigma}^2$, and covariance with the function value for the new parameter value setting available from the predictive distribution, as it given in the eighth step of the method embodiment 200. In a very common scenario, this has the undesirable consequence that among all possible new parameter value settings, $x^*$, the parameter value setting with the largest univariate Expected Improvement is the setting that is arbitrarily close to the current maximum, $\hat{x}$. Thereby, the univariate Expected Improvement criterion will end up suggesting points arbitrarily close to the current maximum, only because the covariance is neglected. The bivariate Expected Improvement designed by the inventor avoids this undesirable behavior, because the covariance is included.

On the downside, the bivariate Expected Improvement approach requires the entire covariance matrix of the predictive distribution, from the eighth step, to be computed and stored. With only a small number of parameters, say more than three, the size of the covariance matrix will be way too big to be stored in a hearing aid system memory, even with tens of GB of available memory. Therefore, it is advantageous, that an analytical expression for the bivariate Expected Improvement is provided because this allows it to be maximized with a gradient ascend procedure, which does not require the entire covariance matrix to be computed and stored.

However, according to one variation, a univariate Expected Improvement may be applied nevertheless. The general formula for the Expected Improvement is identical for the bivariate and univariate variants but the mean $\mu_1$ and the variance $\sigma_1^2$ are defined differently:

$$\mu_I=\mu_*-\mu_{max},$$

and $$\sigma_I^2=\sigma_*^2,$$

wherein the function value at the maximum, $f(\hat{x})$, is considered to be deterministic with a value equal to $\mu_{max}$, and wherein the terms $\sigma_{max}^2$ and $2Cov_{max,*}$ from the bivariate variant obviously are not included in the univariate variant (since the function value at the maximum, $f(\hat{x})$, is not a not stochastic variable and therefore does not contribute to the variance).

According to a ninth step of the present embodiment a measure derived from the Expected Improvement is obtained by taking the average of a normalized bivariate Expected Improvement according to the present embodiment and as already described above.

The normalization is carried out by considering a zero mean Gaussian Process (i.e. a Gaussian Process without any data points).

For the zero mean Gaussian Process the distribution for the maximum point is exactly equal to the distribution of all other points, and the maximum is not correlated with any of the other points, hence:

$$\sigma_{I,norm}^2=\sigma_*^2+\sigma_{max}^2-2Cov_{max,*}=\sigma_f^2+\sigma_f^2-0=2\sigma_f^2,$$

which yields:

$$\sigma_{I,norm}=\sqrt{2\sigma_f^2}=\sqrt{2}\sigma_f$$

wherein $\sigma_f$ is a measure of the uncertainty of the user when comparing different parameter settings.

When inserting $\sigma_{I,norm}$ into the formula for the bivariate Expected Improvement, an analytical expression for the normalizing factor $EI_{norm}$ is obtained:

$$EI_{norm} = \mu_{I,norm}\Phi\left(\frac{\mu_{I,norm}}{\sigma_{I,norm}}\right) + \sigma_{I,norm}\mathcal{N}(0|0, 1) = \sqrt{2}\,\sigma_f\frac{1}{\sqrt{2}\sqrt{\pi}} = \frac{\sigma_f}{\sqrt{\pi}}$$

The normalized bivariate EI is advantageous in that it is independent of the specific estimate of the uncertainty of the user ($\sigma_f^2$) when comparing different parameter settings. Thus, in the following it will be assumed that some reasonable value is just assigned to $\sigma_f^2$, since the exact value is not critical for the present purpose.

According to the present embodiment an average of the normalized bivariate Expected Improvement $\widehat{\widehat{EI}}$ is determined based on the normalized bivariate Expected Improvement for all or at least a plurality of parameter settings. According to a variation said plurality of parameter settings are selected at least pseudo-randomly. Thus the average of the normalized Expected Improvement is given as:

$$\widehat{\widehat{EI}} = \frac{\overline{EI}}{EI_{norm}} = \frac{\sqrt{\pi}\sum_{i=1}^{N} EI_i}{\sigma_f N}$$

wherein N represents the number of said plurality of parameter settings.

According to a preferred variation a logarithm of the average of the normalized Expected Improvement is considered, whereby the resulting values will be considerably easier to illustrate and consequently interpret.

In a tenth step a threshold value of the average of the normalized Expected Improvement representing a converged machine learning procedure (which in the following may also be denoted a personalization run) is determined.

According to the present embodiment, the personalization process (or machine learning procedure) is deemed to fulfill a convergence criterion when a measure at least derived from the Expected Improvement is fallen below or exceeds a convergence threshold.

In variations of the present embodiment different measures may be used to determine a corresponding threshold value, however, in the following all such threshold values may be denoted a convergence threshold.

Generally, two different scenarios are considered when determining a convergence threshold value. The first scenario concerns the case where the threshold value is set too high, which has the negative consequence that some hearing aid system users are not allowed to carry out sufficiently many iterations in order to reach a preferred parameter setting. The second scenario concerns the case where the threshold is set too low such that an unnecessary number of iterations are carried out.

In yet other variations other convergence criteria than convergence thresholds may be used and in obvious variations the convergence thresholds may be lower or upper thresholds dependent only of the formulation of the measure that the convergence threshold is based on. Thus, a lower convergence threshold means that the convergence criterion is reached when the considered measure falls below the threshold and correspondingly an upper convergence threshold means that the convergence criterion is reached when the considered measure exceeds the threshold.

According to the present embodiment three different parameters are varied in order to achieve a setting that represents a better match with the users internal preference function. According to a specific variation the parameter settings represent the hearing aid system gain applied in respectively the low, medium and high frequency range.

According to a specific variation the maximum number of iterations that is allowed for each personalization run is in the range between 5 and 50, between 5 and 30 or between 10 and 25, when considering three different parameters. However, in further variations these range may also apply when more parameters are selected for personalization. Having a maximum number of iterations may alleviate the negative consequences of the second scenario discussed above.

However, according to a particularly advantageous variation a minimum number of iterations is required in order to ensure that the user is given the chance to identify the preferred setting as discussed with reference to the first scenario. According to a specific variation the minimum number of iterations that is required for each personalization run is in the range between 5 and 20 or between 5 and 15, when considering three different parameters. However, in further variations these range may also apply when more parameters are selected for personalization.

Furthermore according to the present embodiment the convergence threshold is given a fixed value based on data gathered from other hearing aid system users that have carried out a machine learning procedure with the same purpose and the same variable parameter settings to assess or select between.

According to a variation the data gathered, are based on personalization runs carried out without any limitations with respect to minimum or maximum iterations and without any other convergence criterion and based hereon a categorization (which in the following may also be denoted a labelling or a classification) of the data gathered from other hearing aid system users is carried out.

According to a more specific variation a personalization run, as described above, is categorized as having converged (which may also be denoted a good run) if two requirements are fulfilled. The first consists in requiring that once a "best" parameter setting for a particular personalization run provides an average of the normalized Expected Improvement falling below a selected convergence threshold value, then it is not allowed that subsequent iterations leads to the "best" setting providing an average of the normalized Expected Improvement that is above the value of the convergence threshold. The second requirement consists in requiring that after the "best" parameter setting for a particular personalization run provides an average of the normalized Expected Improvement falling below the selected convergence threshold value then a subsequent new "best" parameter setting is not allowed to have an Euclidean distance, in the parameter setting space, to the "best" parameter setting mentioned above, that is larger than a lower Euclidean distance threshold.

On the other hand the personalization run is considered not converged (which may also be denoted a bad run) if an average of the normalized Expected Improvement does not fall below the selected convergence threshold or if the average of the normalized Expected Improvement does fall below the initially selected convergence threshold but the two above mentioned requirements are subsequently not fulfilled.

Now a convergence threshold value is selected based on the gathered data and by considering that if a sufficiently small value of the convergence threshold is selected it may be assumed that only few personalization runs are categorized as converged without actually being so, i.e. it may be assumed that the quality perceived by the user with the parameter setting that leads to the value of the average of the normalized Expected Improvement falling below the convergence threshold can't be significantly improved for most users.

However, the downside of selecting a small value of the convergence threshold is obviously that a relatively high number of iterations may be required to reach that threshold, which is generally not desired with a view to user friendliness.

Therefore, according to the present embodiment, in addition to selecting a maximum number of iterations a convergence threshold value in the range between say −1.5 to −2.5) of the logarithm of the average of the normalized Expected Improvement has been selected.

Hereby a reasonable ratio of converged personalization runs relative to the total number of available personalization runs is obtained.

Thus, according to a variation, a large number of personalization runs without a maximum number of iterations has been used to categorize the personalization runs as either good (i.e. converged) or bad (i.e. not converged). Hereby, it has been found that some of the personalization runs don't converge because the hearing aid system user is inconsistent in his selections or assessments of the various parameter settings and consequently that a potentially significantly improved parameter setting may not be found. This may be due to changes in the surroundings or due to some other kind of disturbance during the personalization run.

Having categorized these personalization runs it turns out that the good runs on average provide a steeper gradient towards minimizing the average of the normalized Expected Improvement than the bad runs and based on this difference a categorization of new personalization runs as either good or bad can be made.

Hereby at least one of the values of the convergence threshold value, the maximum number of iterations and the minimum number of iterations, for the new categorization runs, may be adapted in dependence on a categorization of the new personalization run as either a good or a bad run. This may be achieved independent on the method of categorization.

According to a more specific variation a smaller value of the convergence threshold is selected for the new personalization runs categorized as good runs compared to the bad runs whereby usability of the personalization feature is improved.

According to another specific variation a higher value of the maximum number of iterations is selected for the good runs compared to the bad runs.

According to yet another variation the user is notified that it is recommended that a new personalization run is carried out if the present run is categorized as bad.

According to a further variation the user is notified that it is recommend that a new personalization run is carried out if the hearing aid system has detected that the sound environment has changed significantly during the personalization process or the power supply falls below a critical level.

According to yet another variation the categorization of a new personalization run is based on at least one classifier from a group of classifiers comprising deep neural network classifiers, support vector machine classifiers, gaussian process classifiers and logistic regression classifiers, wherein the classifier is trained based on data from a multitude of hearing aid system users.

According to a more specific variation the fixed convergence threshold value is determined based on evaluating statistically the progression of the Expected Improvement as a function of the number of iterations and selecting a threshold value that represents a point where statistically the gradient of the Expected Improvement as a function of the number of iterations approaches zero.

In an eleventh step the progress towards finding the users preferred parameter settings based on the average of the normalized Expected Improvement and its convergence threshold is estimated according to the relation:

$$\text{Progress} = \text{Max}\left[0, \text{Min}\left[1, \frac{\log(\widehat{\widehat{EI}})}{\log(\widehat{\widehat{EI}}_{thr})}\right]\right]$$

wherein $\widehat{\widehat{EI}}_{thr}$ represents the convergence threshold

However, according to a variation the progress is estimated according to the relation:

$$\text{Progress}=\tfrac{1}{2}\text{Prog}A+\tfrac{1}{2}\text{Prog}B$$

wherein $$ProgA = \text{Min}\left[1, \frac{\text{iterations}}{\text{Minimum iterations}}\right],$$

$$ProgB = \text{Max}[ProgB1, ProgB2]$$

and wherein $$ProgB1 = \text{Max}\left[0, \text{Min}\left[1, \frac{\text{iterations} - \text{Minimum iterations}}{\text{Maximum iterations} - \text{Minimum iterations}}\right]\right],$$

$$ProgB2 = \text{Max}\left[0, \text{Min}\left[1, \frac{\log(\widehat{\widehat{EI}})}{\log(\widehat{\widehat{EI}}_{thr})}\right]\right]$$

it follows that ProgA increases from zero to one, when the number of iterations increases from zero and to the minimum number of iterations and remains a constant with a value of one thereafter, and it follows that ProgB1 increases from zero to one when the number of iterations increases from zero and to the maximum number of iterations, and it follows that ProgB2 increases from zero to one, when the average of the normalized Expected Improvement approaches the convergence threshold and remains a constant with a value of one thereafter even if the average of the normalized Expected Improvement becomes significantly more negative than the convergence threshold.

Hereby, the progress measure according to the present variation represents both the number of iterations carried out and the distance between the average of the normalized Expected Improvement and the convergence threshold, which may be advantageous. Furthermore, it is noted that the formula ensures that a progression of 100% is only achieved when both the minimum number of iterations has been carried out and at least one of the maximum number of iterations being been carried out and the average of the normalized Expected Improvement falling below the convergence threshold.

In a twelfth step information representing the progress of the personalization process is provided to the hearing aid system user through a graphical illustration on a display device comprised in the hearing aid system.

According to variations the graphical illustration comprises an empty geometrical figure, such as a bar or a circle of a fixed length that gradually is filled, such that the degree of filling reflects how far the personalization process has progressed from the starting point and how close the process is to convergence. According to other variations, that may be combined with the previously mentioned, colors may be used to signal the progress, e.g. by letting green signal that the personalization process is close to convergence and letting red signal that the process is far from convergence.

According to still other variations of the present invention an improved first guess of parameter settings is made dependent on specific user characteristics such as age, gender and experience with wearing hearing aid systems by associating the user with a group (i.e. cluster) of other users having similar characteristics and then using some average of the resulting parameter settings for the good runs obtained by the users within said cluster as a first guess of parameter settings for the specific user.

Figure 1:
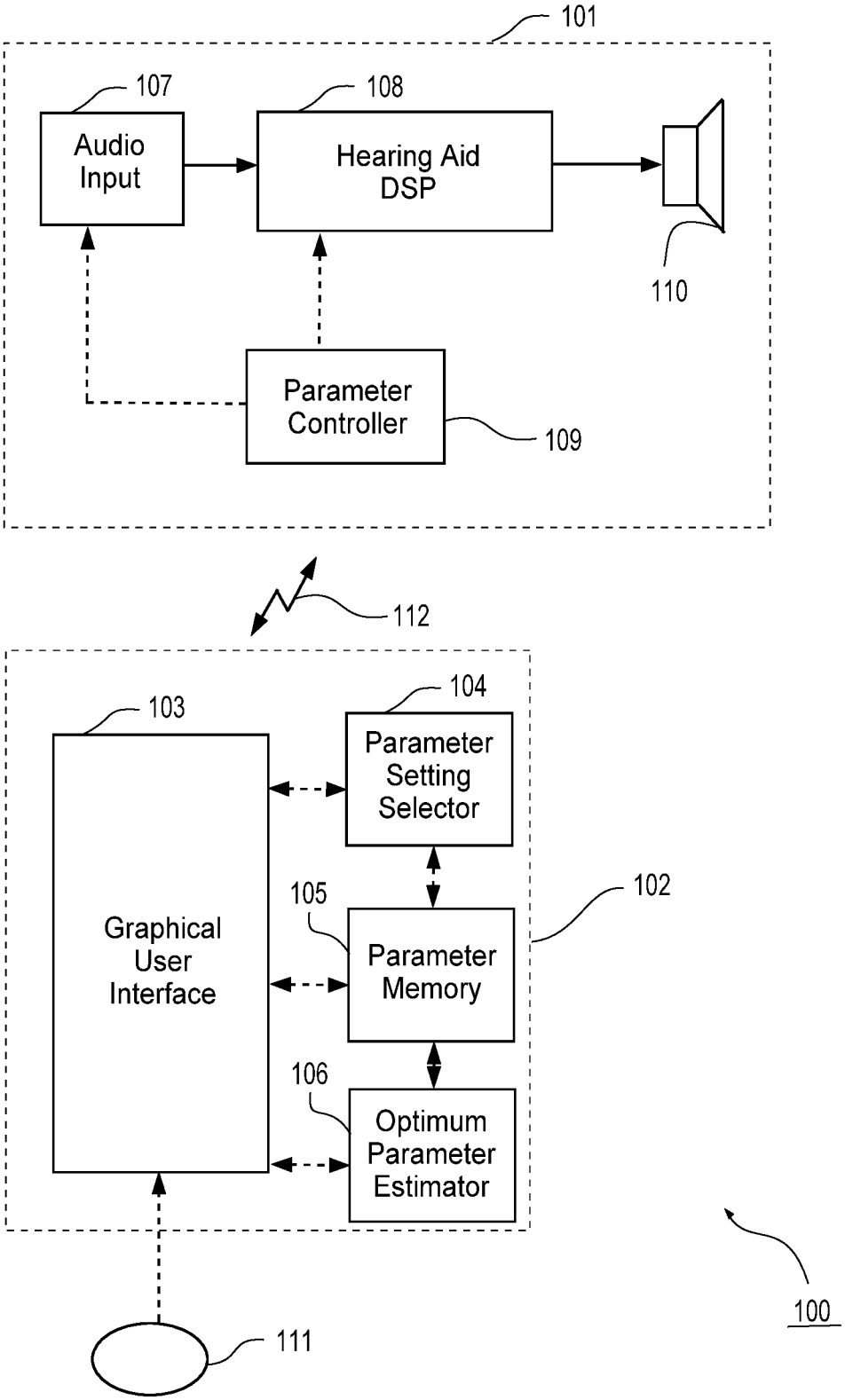
FIG. 1 illustrates highly schematically a hearing aid system according to an embodiment of the invention.

Reference is now made to FIG. 1, which illustrates highly schematically a hearing aid system 100 according to a second embodiment of the invention. The hearing aid system 100 comprises a hearing aid 101 and an external device (which in the following may also be denoted a display device) 102. The external device 102 comprises a graphical user interface 103, a parameter setting selector 104, a parameter memory 105 and an optimum parameter estimator 106. The hearing aid 101 comprises an audio input 107, a hearing aid digital signal processor (DSP) 108, a parameter controller 109 and an electrical-acoustical output transducer 110.

The graphical user interface 103 is adapted to allow a hearing aid system user 111 to select a number of hearing aid parameters for personalization to the hearing aid system user's preference. The parameter memory 105 holds information, on the parameters that may be selected for personalization, such as the ranges wherein the parameters are allowed to vary.

The parameter setting selector 104 comprises an algorithm that allows the next two parameter value settings that are to be rated by the hearing aid user 111 to be determined, and the parameter setting selector 104 is further adapted to provide said two parameter value settings to be transmitted to the parameter controller 109 of the hearing aid 101.

The parameter controller 109 is adapted to control either the audio input 107, in case sound is to be generated synthetically in the hearing aid or the hearing aid digital signal processor 108, in case the hearing aid DSP 108 uses the parameters to be rated when processing sound from the audio input 107.

The audio input 107 may either provide synthetically generated electrical signals representing e.g. relaxing sounds or may relay signals received from one or more acoustical-electrical transducers.

The hearing aid DSP 108 is adapted to process the electrical signals representing sounds that are received from the audio input 107 and provide the processed signals to the electrical-acoustical transducer 110, in order to alleviate a hearing loss by amplifying sound at frequencies in those parts of the audible frequency range where the user suffers a hearing deficit.

The optimum parameter estimator 106 is adapted to estimate the parameter value setting that the hearing aid system user 111 prefers based on the user responses provided by the hearing aid system user 111, using the graphical user interface 103, and the parameter value settings evaluated as described in great detail with reference to the first embodiment and its variations.

The optimum parameter estimator 106 is furthermore adapted to provide the preferred parameter setting to the hearing aid, in order to adjust the parameter setting in the hearing aid and hereby finalizing the personalization process. This may be done in response to a user input triggering this, in response to the user having carried out a predetermined number of ratings or in response to some other convergence criterion being fulfilled as already disclosed above.

The graphical user interface 103 is adapted to illustrate the progress of the personalization process (i.e. the machine learning procedure) as already described in the previous embodiment and its variations. This involves displaying a plurality of machine learning procedure screens adapted to prompt the hearing aid system user (111) to input his selection or assessment of one or more hearing aid system settings in order to determine a preferred hearing aid system setting, wherein said plurality of machine learning procedure screens comprises a graphical illustration of an estimate of the progress of a machine learning procedure towards reaching said preferred hearing aid system setting.

According to a specific variation the hearing aid system 100 is adapted to interact with a remote internet server by transmitting to the remote internet server the tested parameter settings and the corresponding user responses. The remote internet server is configured to receive this type of data from a multitude of hearing aid system users and based hereon update at least one specific characteristic of a selected convergence criterion such as the value of a convergence threshold, the minimum or the maximum number of allowed iterations and the remote internet server can then push these updated characteristics to a multitude of hearing aid systems, whereby the performance of the personalization process can be continuously improved.

According to a further variation the internet server may use the tested parameter settings and the corresponding user responses received from a multitude of hearing aid systems to update the values of the hyper parameters of the model according to the first embodiment and its variations and push the updated values back to the hearing aid systems.

According to further variations the hearing aid system 100 is adapted to interact with the remote internet server by transmitting to the remote internet server at least one of a plurality of observed estimates of progress in a machine learning procedure and parameters of the predictive or posterior distribution. In a more specific variation said parameters of the predictive or posterior distribution may be used by the remote internet server to transmit back an estimate of the progress in a machine learning procedure to the hearing aid system.

Generally, the features that according to the first and second embodiments are carried out by the hearing aid system may be distributed at least partly to a remote internet server.

According to further variations the hearing aid system may also be adapted to transmit specific user characteristics such as age, gender and experience with wearing hearing aid systems to the remote server, which is then configured to associate the user with a group (i.e. cluster) of other users having similar specific characteristics and then using some average of the resulting parameter settings for the good runs obtained by the users within said cluster as a first guess of parameter settings for the specific user and then transmitting that parameter setting back to the hearing aid system to be used in the personalization process.

According to yet another variation the remote internet server is configured to categorize data representing a personalization run as either good or bad and transmit this result to the corresponding hearing aid system. According to a further variation the corresponding hearing aid system is adapted to, in response to said received categorization, notify the corresponding hearing aid system user that it is recommended that a new personalization run is carried out if the present run is categorized as bad.

Generally, the variations, mentioned in connection with a specific embodiment, may, where applicable, be considered variations for the other disclosed embodiments as well.

This is especially true with respect to the fact that the disclosed methods may be used for any type of personalization of hearing aid system settings.

This is also true with respect to the methods of selecting the values of the hyper parameters for both the covariance and likelihood functions and other functions.

However according to a specific variation at least some of the hyper parameters, including at least the length scale hyper parameter is determined based on the data gathered from other hearing aid system users and the categorization of these data into good and bad personalization runs.

In the present context the distributions over the unknown function values of the user's internal response function are primarily expressed such that the hyper parameters appear explicitly. However, in case this is not the case everywhere the hyper parameters are obviously assumed to be implicitly disclosed.

Furthermore, this is true with respect to whether mapping (that may also be denoted warping) techniques are applied to the observations carried out as part of the methods of the present invention.

This is likewise true for the methods for determining the next parameter value settings to be selected or assessed by the user. The present invention does not depend on a specific method for determining the next parameter value settings, although the disclosed method based on the bivariate Expected Improvement may be significantly advantageous with respect to suggesting next parameter value settings. However, in a variation of the first embodiment the next new setting needs not be determined using the bivariate Expected Improvement method. Instead the next new setting may be determined based on say a univariate Expected Improvement estimate.

Concerning the specific use of a measure at least derived from the Expected Improvement for estimating the progress in the machine learning procedure, it is emphasized that a number of variations exist for determining the Expected Improvement in addition to the method given in the first method embodiment 200.

According to one variation, a univariate Expected Improvement may be applied as already discussed above.

According to yet another variation various parameter settings are assessed one by one, as opposed to the first method embodiment 200, wherein two parameter settings are compared and an assessment of the relative preference of one setting over the other is given. According to this variation the general expression for the bivariate Expected Improvement will still be the same namely:

$$\text{Expected Improvement} = \mu_I \Phi\left(\frac{\mu_I}{\sigma_I}\right) + \sigma_I \mathcal{N}\left(\frac{\mu_I}{\sigma_I} \middle| 0, 1\right),$$

but the estimates of the mean and variance will be different:

$$\mu_I = (k_*(x^*) - k_*(\hat{x})) \cdot K^{-1} y,$$

and $$\sigma_I^2 = k(x^*, x^*) + k(\hat{x}, \hat{x}) - k(x^*, \hat{x}) - k_*(x^*)^T K^{-1} k_*(x^*) - k_*(\hat{x})^T K^{-1} k_*(\hat{x}) - k_*(x^*)^T K^{-1} k_*(\hat{x}),$$

wherein y represents the results of the assessment of the different parameter settings.

According to further variations neither the next parameter setting to be evaluated nor the convergence criterion are based on measures at least derived from estimates of the Expected Improvement, instead other measures from information theory such as entropy based measures like cross-entropy based measures and the Value of Perfect Information (VPI) measure may be applied.

According to a more specific variation, a lower convergence threshold for the variance of the predictive distribution is used as convergence criterion according to the relation:

$$\frac{1}{N^*} \sum_{x^* \in X^*} \sigma_*^2(x^*) < \sigma_{thr}^2$$

wherein $\sigma_{thr}^2$ represents the lower convergence threshold and wherein $$\sigma_*^2(x^*) = k(x^*, x^*) - k_*(x^*)^T (M^T M K + \sigma^2 I_{n \times n})^{-1} M^T M k_*(x^*)$$

Furthermore, it is noted that the present invention does not require the use of probabilistic methods, although these are preferred because they are more efficient than parametric methods. Thus, according to a variation an expected utility based on a parameterized model may be used to provide at least one of the convergence criterion and the next parameter setting to be evaluated.

It is likewise independent on a specific embodiment whether the parameters to be personalized are used to control how sound is processed in the hearing aid system or whether they are used to control how sound is synthetically generated by the hearing aid system.

Thus e.g. how the hearing aid system parameters are provided or offered or selected for user personalization does not depend on a specific embodiment. Neither does the method of providing the user response depend on a specific embodiment.

The invention claimed is:

1. A hearing aid system (100) comprising a display device (102), wherein a hearing aid (101) of the hearing aid system (100) operate with the display device (102) to:

display a plurality of machine learning procedure screens adapted to prompt a hearing aid system user (111) to input the user's selection or assessment of one or more hearing aid system settings in order to determine a preferred hearing aid system setting, wherein said plurality of machine learning procedure screens comprises a graphical illustration of an estimate of the progress of a machine learning procedure towards reaching said preferred hearing aid system setting; and wherein the hearing aid system is configured to receive at least one characteristic selected from a group of characteristics comprising a convergence threshold, a minimum number of allowed iterations for the machine learning procedure, a maximum number of allowed iterations, a hyper parameter for a machine learning model adapted to provide the machine learning procedure, a categorization of the machine learning procedure and an estimate of the progress of the machine learning procedure from a remote internet server in response to transmitting to the remote internet server at least one of a plurality of observed estimates of progress in a machine learning procedure, selection or assessment inputs provided by the hearing aid system user and the corresponding parameter settings and parameters of the predictive or posterior distribution.

2. The hearing aid system according to claim 1, wherein said preferred hearing aid system setting is reached in response to the estimate of the progress in the machine learning procedure fulfilling a convergence criterion.

3. The hearing aid system according to claim 1, wherein said preferred hearing aid system setting is reached in response to the estimate of the progress in the machine learning procedure exceeding or falling below a convergence threshold value.

4. The hearing aid system according to claim 3, wherein the estimate of the progress in the machine learning procedure is based on a measure at least derived from an Expected Improvement.

5. The hearing aid system according to claim 1, adapted to notify the hearing aid system user that it is recommended that a new machine learning procedure is carried out in response to a previous machine learning procedure being categorized as bad.

6. The hearing aid system according to claim 1, wherein the estimate of the progress of the machine learning procedure towards reaching said preferred hearing aid system setting is determined based on at least one of selection and assessment data from a multitude of different users.

7. The hearing aid system according to claim 1, wherein the estimate of the progress in the machine learning procedure is based on a parameterized or a probabilistic model of the hearing aid system user's internal response function.

8. A method of operating a hearing aid system comprising the steps of:

selecting a first set of hearing aid system parameters;

providing a first and a second sound based on first and second parameter values;

prompting a user to compare said first and second sounds and hereby provide an observation;

prompting the user to provide a multitude of such observations based on a multitude of different parameter value settings;

determining the likelihood function for a given observation;

obtaining a prior distribution of the users internal response function;

deriving an analytical expression for the posterior function of the users internal response function;

determining an analytical expression for the predictive distribution of the users internal response function;

determining a measure derived from the expected improvement;

determining a convergence threshold for the measure derived from the expected improvement;

estimating the progress towards finding the users preferred parameter values based on the measure derived from the expected improvement and the convergence threshold; and illustrating the progress towards finding the users preferred parameter values in a graphical user interface.

* * * * *